US006717021B2

(12) United States Patent
Romine et al.

(10) Patent No.: US 6,717,021 B2
(45) Date of Patent: Apr. 6, 2004

(54) SOLVATING COMPONENT AND SOLVENT SYSTEM FOR MESOPHASE PITCH

(75) Inventors: H. Ernest Romine, Ponca City, OK (US); John A. Rodgers, Dayton, TN (US); W. Mark Southard, Ponca City, OK (US); Edward J. Nanni, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 302 days.

(21) Appl. No.: 09/873,754

(22) Filed: Jun. 4, 2001

(65) Prior Publication Data

US 2002/0011427 A1 Jan. 31, 2002

Related U.S. Application Data

(60) Provisional application No. 60/211,439, filed on Jun. 13, 2000.

(51) Int. Cl.[7] ..... C10C 3/08

(52) U.S. Cl. ..... 585/5; 208/39; 208/45; 208/23; 208/131; 208/4; 208/7; 208/6; 208/22; 585/1; 585/2; 585/3; 585/4

(58) Field of Search ..... 208/45, 39, 22, 208/23, 131, 4, 7, 6; 585/1, 2, 3, 4, 5

(56) References Cited

U.S. PATENT DOCUMENTS

| | | | | |
|---|---|---|---|---|
| 4,035,281 | A | 7/1977 | Espenscheid et al. | 208/8 |
| 4,108,758 | A | 8/1978 | Schoennagel et al. | 208/8 |
| 4,119,523 | A | 10/1978 | Baldwin et al. | 208/8 |
| 4,133,740 | A | 1/1979 | Paraskos et al. | 208/8 |
| 4,188,235 | A | 2/1980 | Espenscheid et al. | 106/278 |
| 4,188,279 | A | 2/1980 | Yan | 204/294 |
| 4,211,576 | A | 7/1980 | Yan | 106/278 |
| 4,264,428 | A | 4/1981 | Schoennagel et al. | 208/8 |
| 4,354,922 | A | 10/1982 | Derbyshire et al. | 208/68 |
| 4,374,015 | A | 2/1983 | Brule | 208/8 |
| 4,462,894 | A | 7/1984 | Moriya et al. | 208/40 |
| 4,615,791 | A | 10/1986 | Choi et al. | 208/107 |
| 4,892,644 | A | 1/1990 | Choi et al. | 208/107 |
| 4,988,446 | A | 1/1991 | Haberman et al. | 210/656 |
| 5,091,072 | A | 2/1992 | Tsuchitani et al. | 208/39 |
| 5,092,983 | A | 3/1992 | Eppig et al. | 208/323 |
| 5,259,947 | A | 11/1993 | Kalback et al. | 208/44 |
| 5,437,780 | A | 8/1995 | Southard et al. | 208/45 |
| 5,489,374 | A | 2/1996 | Romine et al. | 208/45 |
| 5,501,788 | A | 3/1996 | Romine et al. | 208/45 |
| 5,968,812 | A | 10/1999 | Mrachko | 435/262 |

FOREIGN PATENT DOCUMENTS

| | | |
|---|---|---|
| EP | 0 378 326 A2 | 7/1990 |
| EP | 0 757 089 A1 | 2/1997 |
| JP | 58113292 | 7/1983 |
| WO | WO93/24590 | 12/1993 |

OTHER PUBLICATIONS

International Search Report from International Application No. PCT/US01/18523, filed Jun. 7, 2001.

*Primary Examiner*—Walter D. Griffin
*Assistant Examiner*—James Arnold, Jr.
(74) *Attorney, Agent, or Firm*—Fish & Richardson PC

(57) ABSTRACT

A solvating component for a solvated mesophase pitch. The solvated component includes a mixture of aromatic hydrocarbons having boiling points in the atmospheric equivalent boiling point range of about 285° to about 500° C. (about 550° F.–932° F.). At least 80% of the carbon atoms of the hydrocarbons are aromatic as characterized by carbon 13 NMR. The aromatic hydrocarbons are selected from a group consisting of aromatic compounds having 2 to 5 aromatic rings, substituted aromatic compounds having 2 to 5 aromatic rings wherein said substituents are alkyl groups having 1 to 3 carbons, hydroaromatic compounds having 2 to 5 rings, substituted aromatic compounds having 2 to 5 rings wherein said substituents are alkyl groups having 1 to 3 carbons, and mixtures thereof.

8 Claims, 1 Drawing Sheet chrysene 1, 7 - dimethyl chrysene 5, 6 - dihydro chrysene

1 - methyl, 5, 6 - dihydro chrysene dibenzothiophene

SOLVATING COMPONENT AND SOLVENT SYSTEM FOR MESOPHASE PITCH

CROSS-REFERENCE OF RELATED APPLICATION

This application claims priority to U.S. Provisional Application No. 60/211,439, filed Jun. 13, 2000.

BACKGROUND OF THE INVENTION

1. Field of the Invention

The present invention relates to improvements in solvated mesophase pitch. More specifically, the current invention provides a solvent system suitable for use as the solvating component of high melting or unmeltable mesophase pitches. Additionally, the current invention provides a solvent system suitable for producing a high molecular weight mesophase pitch.

2. Prior Art

Mesophase pitches are carbonaceous materials which contain mesophases exhibiting optical anisotropy due to an agglomerated layered structure. The molecules have aromatic structures which through interaction are associated together to form ordered liquid crystals which are either liquid or solid depending on temperature. Mesophase pitch is not ordinarily available in existing hydrocarbon fractions obtained from normal refining procedures. Mesophase pitch, however, can be prepared by treatment of aromatic feedstocks which is well known in the art. In known processes, a growth reaction converts relatively small aromatic molecules into larger mesophase-size molecules and these molecules are concentrated. Thus, mesophase is extracted from pitch by treatment of aromatic feedstocks.

It is known that mesophase pitches can be drawn into pitch based carbon fibers which have numerous commercial uses. A challenge in preparing a high-performance carbon fiber from a mesophase pitch resides in the fact that a significantly high temperature is necessary to use at the spinning stage because of the high softening point of the pitch.

The present invention is a product of ongoing research in the field of solvated mesophase pitch. Solvated mesophase pitches were disclosed as early as U.S. Pat. No. 5,259,947 (owned by the Assignee herein) which is incorporated herein by reference. The solvated mesophase contains a small percentage by weight of solvent in the liquid crystalline structure so that it melts or fuses at a lower temperature. As noted, in the '947 Patent and subsequent patents relating to this subject matter, solvated mesophase pitch has several advantages over traditional mesophase pitch. A primary advantage is the ability to use high melting or unmeltable mesophase pitch in carbon fiber spinning processes.

Prior to the current invention, the principal solvents used as the solvating component consisted of 1 to 3 ring aromatic compounds. The aromatics are a series of hydrocarbon ring compounds. While these 1 to 3 ring compounds are effective, they provide only a limited range of compatibility with heavy aromatic pitches.

In some applications, it is advantageous to have higher boiling point solvating solvents. This allows processing of the melted pitches at ordinary (in other words, atmospheric) pressure.

It is additionally advantageous to have higher boiling point solvating solvents which extend to higher temperatures. This will extend the range over which solvent evaporation rates are controlled when making or processing pitch artifacts.

It is, therefor, a principal object and purpose of the present invention to produce new solvents which makes processing of the carbon pitches more facile.

It is a further additional object and purpose of the present invention to produce a new solvent or solvating agent which solvates especially high melting mesogens.

It is a further object and purpose of the present invention to produce a novel solvent which promotes increased fiber attenuation during spinning.

It is a further object and purpose of the present invention to provide a high boiling point aromatic solvent as a useful component in extracting solvents in order to isolate heavy aromatic pitches from isotropic or mesophase pitches.

It is a further object and purpose of the present invention to isolate mesogenic insolubles by solvent fractionation.

SUMMARY OF THE INVENTION

The current invention provides a solvent system suitable for use as the solvating component of a solvated mesophase pitch. The solvent system comprises a mixture of aromatic hydrocarbons having boiling points in the atmospheric equivalent boiling point ("AEBP") range of about 285° to about 500° C. (about 550°–932° F.). In the solvent system, at least 80% of the carbon atoms are aromatic as characterized by carbon 13 NMR.

The aromatic hydrocarbon compounds making up the solvent system are selected from the group consisting of (i) aromatic compounds and N, O and S heteroaromatic compounds having 2 to 5 aromatic rings, (ii) substituted aromatic compounds and N, O and S heteroaromatic compounds having 2 to 5 aromatic rings wherein said substituents are alkyl groups having 1 to 3 carbons ($C_1$ to $C_3$), (iii) hydroaromatic compounds and N, O and S heteroaromatic compounds having 2 to 5 aromatic rings, (iv) substituted hydroaromatic compounds and N, O and S heteroaromatic compounds having 2 to 5 rings wherein said substituents are alkyl groups having 1 to 3 carbons, and (v) mixtures thereof. Additionally the aromatic hydrocarbon compounds can contain up to ten weight percent (10%) heteroatoms of nitrogen, oxygen and sulfur. When present, the heteroatoms predominately occur in stable aromatic ring structures such as pyrroles, pyridines, furans and thiophenes. The new solvents proposed herein facilitate the handling and use of solvated mesophase pitch.

The current invention additionally provides a solvent system for extracting isotropic and mesophase pitches. The solvent system suitable for extracting the pitches comprises a first solvent system as described above for solvating a mesophase pitch in combination with a second aromatic solvent system comprising 1 to 3 ring aromatic compounds having a solubility parameter in the range of 8 to 11.5 wherein said substituents are alkyl groups having 1 to 3 carbons, and mixtures thereof. The ratio of the first solvent system to the second solvent system may range from about 1:20 to about 2:5.

The extraction solution is added to a pitch in a solution to pitch ratio ranging from about 3:1 to about 20:1. The pitch is then extracted to yield a mesogen residue. Using the inventive solvent system, one achieves excellent control of the extraction process. Additionally, any residual solvent in the mesogen product is a suitable solvent for forming a solvated mesophase pitch.

DETAILED DESCRIPTION OF THE PREFERRED EMBODIMENTS

Figure 1:
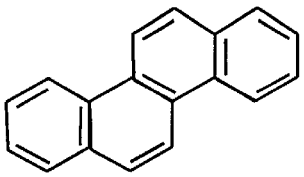
FIGS. 1 through 5 illustrate examples of aromatic compounds that make up the solvent system which comprise a part of the present invention.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention provides a solvent system for use as the solvating component of a solvated mesophase pitch. The current invention also provides a solvent system for extracting isotropic and mesophase pitches. The present invention allows isolation of mesogenic insolubles by solvent fractionation. Additionally, the present invention provides a high molecular weight mesophase pitch and a process to produce a high molecular weight mesophase pitch.

The solvents of the invention are versatile, but inexpensive, that can be used to facilitate the processing of isotropic and mesophase pitches. The hydrocarbons in the preferred embodiment have at least 80% of the carbon atoms as aromatic. The aromatic content may be determined by carbon 13 NMR (a naturally occurring isotope testing). The solvents can be employed both as solvents and co-solvents to aid in the extraction of isotropic and mesophase pitches and as solvating agents to lower the viscosity of pitches. Whether they act as extraction solvents or solvating agents depends upon the amount of solvent combined with the pitch and/or whether a co-solvent is used.

As extraction solvents, the aromatic solvents of the invention are generally combined with lower solubility parameter neat aromatic hydrocarbon solvents, such as toluene, xylene, or benzene, to produce mixed solvents systems. The mixed solvents are used to extract isotropic and mesophase pitches in solvent-to-pitch ratios of 3:1 to 20:1. Thermally cracked solvents in the mixed solvent increase solvent solubility parameters, and thereby promote extraction of high molecular weight material from isotropic and mesophase pitches which results in heavy or high molecular weight, high melting mesogens as the extraction residue. The yield of mesophase is indirectly related to the concentration of aromatic solvent of the invention in the mixed solvents; the melting point of the mesogens is directly related to solvent concentration; consequently, concentration of aromatic solvent used in extractions of isotropic and mesophase pitches is useful in controlling properties of the resulting residual mesogens.

Aromatic solvents of the invention can also be used to solvate mesogens. At low solvent amounts of 5 to 30 weight percent, the resulting solvated mesophase pitch is typically 100 percent anisotropic. At higher solvent amounts of 20 to 40 or more weight percent solvent, there tends to be up to 60 volume percent isotropic phase in the solvated mesophase pitch. The fluid or melting temperature of the solvated mesophase pitch generally decreases with increasing solvent addition. In many uses the most desirable solvated mesophase pitch is the pitch having the lowest melting or fluid temperature consistent with maintaining 100 percent anisotropy. Since higher solvent contents give lower fluid temperatures, this corresponds to the highest solvent content solvated mesophase pitch consistent with maintaining 100 percent anisotropy. It has been discovered that this most desirable product is obtained with highly aromatic mixed solvents. Substantially aromatic mixtures having >80% and preferably >85% aromatic carbons by carbon 13 NMR testing are effective.

It has further been discovered that a fairly narrow boiling range aromatic solvent is preferred. The preferred aromatic solvent has at least 80 percent of its components boiling within ±60° C. and more preferably within ±30° C. of the mean boiling point.

The ability to reduce the viscosity of solvated mesophase pitches and to control the melting temperature of mesogens by the addition of aromatic solvents is useful in mesophase pitch applications such as pitch carbon fiber spinning and composite impregnation. In particular with regards to fiber spinning, mesophases solvated with these solvents can be spun at lower temperatures. In addition, there is better control of attenuation during spinning using the solvents of the present invention. Evaporation of volatile pitch components from the hot molten pitch at the die tip is one of the factors limiting the ability to attenuate pitch fibers to small diameters. Aromatic solvents of the invention can have very low vapor pressures at the solvated pitch spinning temperatures, thereby allowing excellent pitch attenuation to small diameter fibers.

The aromatic solvents of the present invention are mixtures of aromatic hydrocarbons having boiling points in the atmospheric equivalent boiling point range of about 285° to about 500° C. (about 550°–932° F.). At least 80% of the carbon atoms of the hydrocarbons are aromatic as measured by carbon 13 NMR. The aromatic hydrocarbons are selected from the group consisting of (i) aromatic compounds and N, O and S heteroaromatic compounds having 2 to 5 rings, (ii) substituted aromatic compounds and N, O and S heteroaromatic compounds having 2 to 5 rings wherein substituents are alkyl groups having 1 to 3 carbons, (iii) hydroaromatic compounds and N, O and S heteroaromatic compounds having 2 to 5 rings, (iv) substituted hydroaromatic compounds and N, O and S heteroaromatic compounds having 2 to 5 rings wherein said substituents are alkyl groups having 1 to 3 carbons and (v) mixtures thereof. Additionally the aromatic hydrocarbon compounds can contain up to ten weight percent heteroatoms of nitrogen, oxygen and sulfur. When present, the heteroatoms predominately occur in stable aromatic ring structures such as pyrroles, pyridines, furans and thiophenes.

Figure 2:
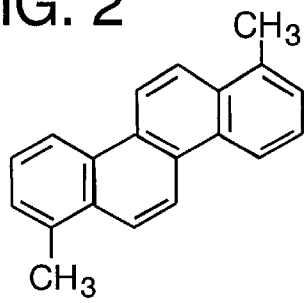
Figure 3:
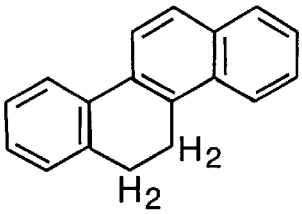
Figure 4:
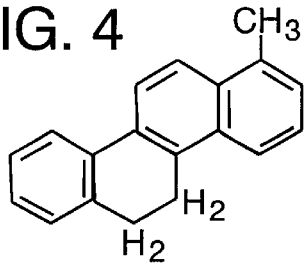
Figure 5:
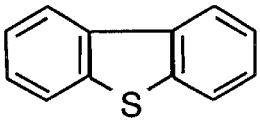

FIGS. 1 through 5 illustrate non-limiting examples of aromatic hydrocarbons useful in the present invention. FIG. 1 illustrates an example of an aromatic compound having 2 to 5 rings, in this case, a four ring aromatic, chrysene. FIG. 2 illustrates an example of a substituted aromatic compound having 2 to 5 rings wherein the substituents are alkyl groups having 1 to 3 carbons. In this case, a four ring alkyl aromatic, 1,7-dimethylchrysene. FIG. 3 illustrates an example of a hydroaromatic compound having 2 to 5 rings, in this case a four ring hydroaromatic, 5,6-dihydrochrysene. FIG. 4 illustrates an example of a substituted hydroaromatic compound having 2 to 5 rings wherein the substituents are alkyl groups having 1 to 3 carbons, in this case, 1-methyl, 5,6-dihydrochrysene. Finally, FIG. 5 illustrates a sulfur-containing heterocyclic aromatic compound having 2 to 5 rings with a thiophenic ring, dibenzothiophene.

Aromatic solvents suitable for the present invention can be obtained from a number of sources including refinery coker liquids, gas oils, decant oils, coal tars and chemical tars such as ethylene tars. Such naturally occurring mixtures are preferred over pure compounds in the inventive range because they are readily available, much lower in cost and tend to remain liquid over a wide range of useful temperatures. In some cases the solvent must be thermally cracked to increase aromatic carbon content to greater than 80% in order to make the solvent useful.

In a preferred embodiment of the invention, the aromatic solvent is obtained from thermally cracked decant oil distillate. Decant oil is topped to prepare a distillate boiling in the range of 285° to 500° C. This clean distillate is thermally cracked at 400° to 540° C. at up to 1000 psig for a time sufficient to convert the residue to greater than 80% and preferably greater than 85% aromatic carbons as measured by carbon 13 NMR. The thermally cracked decant oil distillate is vacuum distilled to obtain an aromatic solvent having the boiling range, aromaticity and chemical structures described herein for the inventive solvent.

Figure 6:
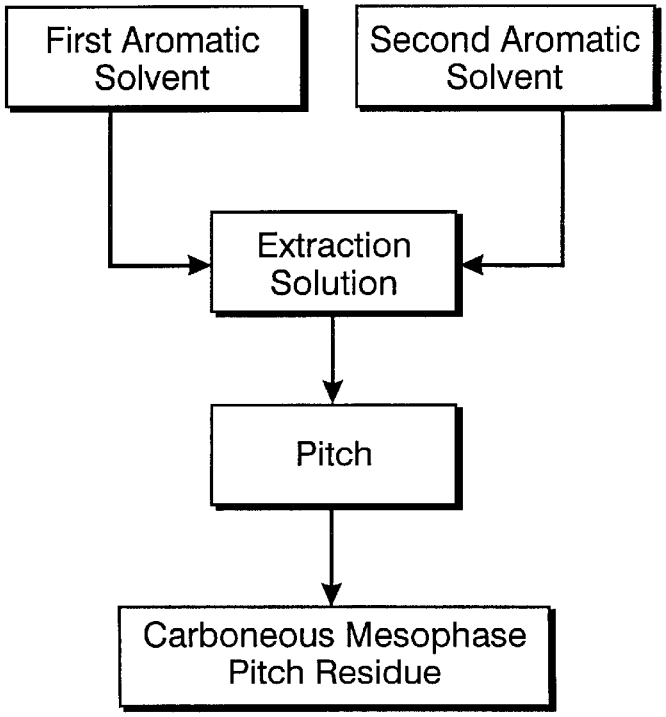
FIG. 6 is a diagrammatic representation of an extraction process to produce a high molecular weight mesophase pitch in accordance with the present invention.

A process of using the aromatic solvents of the present invention to produce high molecular weight mesogens is illustrated in FIG. 6. Initially, the first aromatic solvent having boiling points in the atmospheric equivalent boiling point range of about 285° to 500° C. are combined with a second solvent system. The first aromatic solvent is the heavy aromatic solvent of the invention described above. The second solvent system has a solubility parameter in the range of 8 to 11.5. The ratio of the first solvent system to the second solvent system ranges from 1:20 to 2:5. The combination of the first aromatic solvent and the second aromatic solvent results in an extraction solution. The extraction solution is thereafter added to a pitch, in a solution to pitch ratio ranging from about 3:1 to about 20:1. Thereafter, the pitch is extracted by use of the extraction solution. The yield is a residue of mesogens.

The addition of the inventive aromatic solvent to a secondary solvent increases the solubility parameter of the extraction solution. The higher solubility parameter promotes extraction, resulting in recovery of high molecular weight, high melting mesogens. Mesogens melting at a temperature of 375° C. or above are easily obtained.

EXAMPLE 1

Example 1 shows saturation data for the stepwise addition of an aromatic solvent of the invention to dry mesogens. Mesogens for Example 1 were obtained by extracting a mesogen-containing isotropic pitch prepared from a thermally treated decant oil fraction. The mesogens in the Example melt at 475° C. as measured by hot stage microscopy. The dry mesogens were combined with increasing amounts of aromatic solvent fractionated from thermally cracked decant oil distillate. Greater than 80% of the solvent boils between 393° and 421° C. Three and four ring aromatics and simple derivatives comprise a substantial portion of material in this boiling range by gas chromatography/mass spectroscopy (GCMS). The solvent tested 90.0% aromatic carbons by carbon 13 NMR.

| Mesogen | | Aromatic Solvating Solvent | | Solvated Mesophase | |
|---|---|---|---|---|---|
| Melting Point, ° C. | With | Boiling Range, ° C. | Added Conc., % | % Anisotropy | T @ 1000 P&100 $s^{-1}$, ° C. |
| 475 | | 393–421 | 18.2 | 100 | 300 |
| | | 393–421 | 20.2 | 100 | 297 |
| | | 393–421 | 22.2 | 100 | 293 |
| | | 393–421 | 24.2 | 100 | 282 |
| | | 393–421 | 26.2 | 100 | 280 |
| | | 393–421 | 28.2 | 100 | 266 |

-continued

| Mesogen | | Aromatic Solvating Solvent | | Solvated Mesophase | |
|---|---|---|---|---|---|
| Melting Point, ° C. | With | Boiling Range, ° C. | Added Conc., % | % Anisotropy | T @ 1000 P&100 $s^{-1}$, ° C. |
| | | 393–421 | 30.2 | 97 | 260 |
| | | 393–421 | 32.2 | 90 | 253 |

Increasing amounts of solvent decreases the fluid temperature of the solvated mesophase. The fluid temperature is shown as the temperature at which the pitch exhibits a viscosity of ~1000 poise at a shear rate of ~100 reciprocal seconds. With this combination of mesogens and solvent, the mesogens become saturated with solvent at around 28 to 30 weight percent. Higher solvent content solvated mesophases are partly isotropic.

EXAMPLE 2

Example 2 shows the improved effectiveness of more aromatic solvents of the invention. Mesogens melting at 395° C. and obtained by extraction of a mesogen-containing pitch are combined with 22% aromatic solvent, greater than 80% of which boils between 338° and 366° C. Two, three and four ring aromatics and simple derivatives comprise a substantial portion of the material in this boiling range according to GCMS analysis.

The aromatic solvents vary from 83 to 89% aromatic carbons by carbon 13 NMR. The more aromatic solvents give lower solvated mesophase fluid temperatures indicating better solvating effectiveness. All of the solvents combined with these mesogens form solvated mesophases with similar small amounts of isotropic phase. Combining 22% 393° to 421° C. boiling solvent of increasing aromatic carbon contents to the mesogens of this Example shows the same trend of reduced fluid temperature for more aromatic solvent.

| Mesogen | | Aromatic Solvating Solvent | | | Solvated Mesophase | |
|---|---|---|---|---|---|---|
| Melting Point, ° C. | With | Boiling Range, ° C. | Aromatic Carbon, % | Added Conc, % | % Anisotropy | T @ 1000 P&100 $s^{-1}$, ° C. |
| 395 | | 338–366 | 83 | 22 | 96 | 216 |
| | | 338–366 | 87 | 22 | | 215 |
| | | 338–366 | 89 | 22 | 90 | 211 |
| | | 338–366 | 88 | 22 | 96 | 209 |
| 395 | | 393–421 | 85 | 22 | | 231 |
| | | 393–421 | 87 | 22 | | 224 |
| | | 393–421 | 91 | 22 | 90 | 226 |
| | | 393–421 | 90 | 22 | 88 | 218 |

EXAMPLE 3

Example 3 is a comparison between an aromatic solvent of the invention and a less aromatic solvent, not of the invention. Mesogens melting at 404° C. and obtained by extraction of a mesogen-containing pitch were combined with 19 to 28% of each solvent. One observes that the ~83% aromatic carbon solvent of the invention combines with the mesogens of this Example to produce a 100% anisotropic solvated mesophase with a fluid temperature <233° C. The lowest fluid temperature obtained at 100% anisotropy with the ~72% aromatic comparative solvent is about 260° C.

The aromatic solvent of the invention of Example 3 was analyzed as containing 1.1% sulfur by elemental analysis. Greater than 90% of this sulfur was found to be in thiophenic aromatic structures.

| Mesogen | | Solvating Solvent | | | Solvated Mesophase | |
|---|---|---|---|---|---|---|
| Melting Point, ° C. | With | Boiling Range, ° C. | Aromatic Carbon, % | Added Conc, % | % Anisotropy | T @ 1000 P&100 $s^{-1}$, ° C. |
| 404 | | | | 19 | 100 | 248 |
| | | 340–400 | ~83 | 22 | 100 | 242 |
| | | | | 25 | 100 | 233 |
| | | | | 28 | 96 | 226 |
| | | | | 19 | 100 | 257 |
| | | 393–416 | ~72 | 22 | 99 | 262 |
| | | | | 25 | 93 | 257 |
| | | | | 28 | 87 | 255 |

EXAMPLE 4

Example 4 shows solvated mesophase pitches formed from mesogens and relatively high and low boiling aromatic solvents of the invention. This illustrates the breadth of applicability of the current teaching.

| Mesogen | | Aromatic Solvating Solvent | | | Solvated Mesophase | |
|---|---|---|---|---|---|---|
| Melting Point, ° C. | With | Boiling Range, ° C. | Aromatic Carbon, % | Added Conc, % | % Anisotropy | T @ 1000 P&100 $s^{-1}$, ° C. |
| 383 | | 340–400 | ~82 | 17 | 100 | 294 |
| | | 455–490 | ~84 | 17 | 100 | 305 |

EXAMPLE 5

Example 5 shows use of the inventive aromatic solvents as components of extraction solvents to isolate mesogens from mesogen-containing pitches. The extractions show excellent control of residue mesogen melting point by making small adjustments in the amount of aromatic solvent used.

| Extraction Solvent | | Solvated Meso. | |
|---|---|---|---|
| Composition | Est. Sol. Param. | Residue % Anisotropy | Dry Mesogen Melting Point, ° C. |
| Xylene | 8.75 | 100% | 390 |
| 95/5 Xylene/ Aromatic Solvent | 8.79 | 100% | 409 |
| 90/10 Xylene/ Aromatic Solvent | 8.83 | 100% | 429 |

EXAMPLE 6

Example 6 shows that aromatic solvents of the invention offer an economical option for obtaining high melting mesogens by extraction. The inventive solvents are inexpensive process byproducts that are effective in small amounts for controlling the melting point of mesogens obtained by extraction of mesogen-containing pitches.

| Extraction Solvent | | Solvated Mesophase Residue | | Dry Mesogen |
|---|---|---|---|---|
| Composition | Est. Sol. Param. | % Anisotropy | T @ 1000 P&100 $s^{-1}$, ° C. | Melting Point, ° C. |
| 60/40 Xylene/ Tetralin | 8.78 | 100% | 221 | 421 |
| 90/10 Xylene/ Aromatic Solvent | 8.83 | 99% | 217 | 417 |

EXAMPLE 7

Example 7 illustrates the ability to spin smaller diameter pitch fibers from the relatively high boiling solvents of the invention. Each pitch was spun at a variety of temperatures and pitch flow rates to identify conditions giving the smallest green fiber diameter. Both inventive solvents are effective in allowing the draw of the solvated mesophase pitches of the examples to small diameter fibers. One skilled in the art of spinning mesophase pitch fibers will note that carbonized fibers from both exemplary green fibers will have <10$\mu$ average diameters.

| Mesogen | | Aromatic Solvating Solvent | | Spinning | Green Fiber |
|---|---|---|---|---|---|
| Melting Point, ° C. | With | Boiling Range, ° C. | Added Conc., % | Temp., ° C. | Ave. Min. Dia., microns |
| 383 | | 340–400 | 17 | 328 | 12.4 |
| | | 455–490 | 17 | 350 | 10.0 |

Whereas, the present invention has been described in relation to the drawings attached hereto, it should be understood that other and further modifications, apart from those shown or suggested herein, may be made within the spirit and scope of this invention.

What is claimed is:

1. A solvating component of a solvated mesophase pitch, said solvating component comprising:

a mixture of aromatic hydrocarbons having boiling points in the atmospheric equivalent boiling point (AEBP) range of about 285° to about 500° C., at least 80% of the carbon atoms of said hydrocarbons are aromatic as characterized by carbon 13 NMR and said aromatic hydrocarbons are selected from the group consisting of (i) aromatic compounds and N, O and S heteroaromatic compounds having 2 to 5 rings, (ii) substituted aromatic compounds and N, O and S heteroaromatic compounds having 2 to 5 rings wherein said substituents are alkyl groups having 1 to 3 carbons ($C_1$ to $C_3$), (iii) hydroaromatic compounds and N, O and S heterohydroaromatic compounds having 2 to 5 rings, (iv) substituted hydroaromatic compounds and N, O and S heterohydroaromatic compounds having 2 to 5 rings wherein said substituents are alkyl groups having 1 to 3 carbons ($C_1$ to $C_3$), and (v) mixtures thereof.

2. A solvating component as set forth in claim 1, wherein at least 80% of the compounds of said solvating component boil within plus or minus 60° C. of the mean boiling point of said solvating components.

3. A solvating component as set forth in claim 1, wherein the total N, O and S heteroatom content is up to 10 weight percent.

4. A solvating component as set forth in claim 1, wherein at least 85% of the carbon atoms of said hydrocarbons are aromatic.

5. A solvating component as set forth in claim 1, wherein said solvating component is a thermally treated decant oil fraction.

6. A mixed solvent system for extracting isotropic and mesophase pitches comprising:

a first aromatic solvent system having boiling points in the atmospheric equivalent boiling point (AEBP) range of about 285° to about 500° C., at least 80% of the carbon atoms of said hydrocarbons are aromatic as characterized by carbon 13 NMR and said aromatic hydrocarbons are selected from the group consisting of (i) aromatic compounds and N, O and S heteroaromatic compounds having 2 to 5 rings, (ii) substituted aromatic compounds and N, O and S heteroaromatic compounds having 2 to 5 rings wherein said substituents are alkyl groups having 1 to 3 carbons ($C_1$ to $C_3$), (iii) hydroaromatic compounds and N, O and S heterohydroaromatic compounds having 2 to 5 rings, (iv) substituted hydroaromatic compounds and N, O and S heterohydroaromatic compounds having 2 to 5 rings wherein said substituents are alkyl groups having 1 to 3 carbons ($C_1$ to $C_3$), and (v) mixtures thereof; and a second aromatic solvent system combined with said first solvent system, said second system comprising aromatic solvents having 1–3 aromatic rings, the ratio of said first solvent system to said second solvent system being from 1:20 to 2:5.

7. A mixed solvent system of claim 6 wherein at least 85% of the carbon atoms of said hydrocarbons of the first solvent system are aromatic.

8. A mixed solvent system of claim 6, wherein the total N, O and S heteroatom content is up to 10 weight percent.

* * * * *